US007516600B1

(12) United States Patent
Flora

(10) Patent No.: US 7,516,600 B1
(45) Date of Patent: Apr. 14, 2009

(54) METHOD OF PACKAGING THERMALLY LABILE GOODS EMPLOYING COLOR-CODED PANELS OF PHASE CHANGE MATERIAL

(75) Inventor: George Flora, Bloomington, MN (US)

(73) Assignee: Minnesota Thermal Science, LLC, Plymouth, MN (US)

( * ) Notice: Subject to any disclaimer, the term of this patent is extended or adjusted under 35 U.S.C. 154(b) by 0 days.

(21) Appl. No.: 11/927,890

(22) Filed: Oct. 30, 2007

Related U.S. Application Data

(60) Provisional application No. 60/866,241, filed on Nov. 17, 2006.

(51) Int. Cl.
*B65B 23/00* (2006.01)

(52) U.S. Cl. ..... 53/472; 53/476; 53/449

(58) Field of Classification Search ..... 53/472, 53/473, 476, 449; 428/920; 206/306, 526, 206/443, 44; 493/93, 114, 98, 95
See application file for complete search history.

(56) References Cited

U.S. PATENT DOCUMENTS

| | | | | | |
|---|---|---|---|---|---|
| 2,289,060 | A * | 7/1942 | Merkle | 426/109 |
| 2,807,402 | A * | 9/1957 | Nelbach | 206/589 |
| 3,236,206 | A * | 2/1966 | Willinger | 119/203 |
| 3,970,068 | A * | 7/1976 | Sato | 126/263.08 |
| 4,037,777 | A * | 7/1977 | Maughan | 229/117.17 |
| 4,145,895 | A * | 3/1979 | Hjertstrand et al. | 62/529 |
| 4,292,817 | A * | 10/1981 | Loucks | 62/457.5 |
| 4,377,075 | A * | 3/1983 | Russo | 62/372 |
| 4,425,998 | A * | 1/1984 | Hof et al. | 206/306 |
| 4,524,565 | A * | 6/1985 | Palm | 53/449 |
| 4,579,170 | A * | 4/1986 | Moses et al. | 165/104.17 |
| 4,619,678 | A * | 10/1986 | Rubin | 62/4 |
| 4,903,493 | A * | 2/1990 | Van Iperen et al. | 62/60 |
| 4,923,077 | A * | 5/1990 | Van Iperen et al. | 206/527 |
| 4,931,333 | A * | 6/1990 | Henry | 428/76 |
| 4,969,595 | A * | 11/1990 | Teasdale | 229/117.17 |
| 5,647,226 | A * | 7/1997 | Scaringe et al. | 62/457.2 |
| 5,899,088 | A * | 5/1999 | Purdum | 62/371 |
| 6,689,035 | B1 * | 2/2004 | Gerber | 493/320 |
| 6,788,984 | B2 * | 9/2004 | Plotkin | 700/97 |
| 2004/0079793 | A1 * | 4/2004 | Mayer | 229/103.11 |
| 2004/0079794 | A1 * | 4/2004 | Mayer | 229/103.11 |

OTHER PUBLICATIONS

Verner, Carl. "Phase Change Thermal Energy Storage". Dissertation. May, 1997.

* cited by examiner

*Primary Examiner*—Sameh H. Tawfik
(74) *Attorney, Agent, or Firm*—Sherrill Law Office, PLLC

(57) ABSTRACT

A method of packaging thermally labile goods. The method includes the steps of (a) obtaining a legend correlating thermally labile goods with a PCM panel color, (b) locating the thermally labile goods to be packaged on the legend and identifying the correlated PCM panel color, (c) obtaining thermally conditioned panels of the correlated PCM panel color from amongst a plurality of differently colored thermally conditioned panels color coded in relation to the phase change temperature of the phase change material contained within the panels, (d) lining the retention chamber of a thermally insulated container with the obtained thermally conditioned PCM panels, (e) placing the thermally labile goods to be packaged into the lined retention chamber, and (f) closing the container.

17 Claims, 6 Drawing Sheets

FIG. 2A

| PRODUCT | TARGET TEMPERATURE RANGE (°C) | PANEL COLOR |
|---|---|---|
| ❑ ❑ ❑ | 0 to 8 | WHITE |
| ○ ○ ○ | 4 to 20 | RED |
| ⊙ ⊙ ⊙ | < -20 | BLUE |
| △ △ △ | -4 to 4 | WHITE |
| ● ● ● | < -20 | BLUE |
| ❋ ❋ ❋ | 2 to 10 | RED |

FIG. 2B

| PANEL COLOR | CONDITIONED TEMPERATURE (°C) | PRODUCT |
|---|---|---|
| RED | 4 | ○ ○ ○<br>❋ ❋ ❋ |
| WHITE | 0 | ❑ ❑ ❑<br>△ △ △ |
| BLUE | -40 | ⊙ ⊙ ⊙<br>● ● ● |

METHOD OF PACKAGING THERMALLY LABILE GOODS EMPLOYING COLOR-CODED PANELS OF PHASE CHANGE MATERIAL

This application claims the benefit of U.S. Provisional Application No. 60/866,241, filed Nov. 17, 2006.

BACKGROUND

A wide variety of goods are thermally labile and therefore need to be maintained above and/or below a target temperature to prevent spoilage, decomposition, deactivation, transformation, conversion, breakdown, etc. Exemplary thermally labile goods include blood, blood products such as red blood cells (RCBs) and blood platelets, transplantable organs, biological tissue, vaccines, antigens, antibodies, bacteriological samples, immunoassays, pharmaceuticals, enzymes, and single-use chromogenic thermometers.

Transportation of thermally labile goods is particularly challenging, especially when the thermally labile goods must be maintained within a narrow temperature range. Numerous insulated shipping containers have been developed over the years, with those deploying a phase change material generally providing superior temperature control over extended periods. A nonexhaustive list of United States Patents and Published Patent Applications disclosing insulated shipping containers employing a phase change material include U.S. Pat. Nos. 4,145,895; 4,579,170; 4,923,077; 4,931,333; 5,626,936; 5,899,088; 6,209,343 and 6,718,776, and United States Patent Application Publications 2005/0188714; 2004/0079794; 2004/0079793 and 2002/0050147.

Insulated shipping containers employing a phase change material can be deployed for a wide range of thermally labile goods over a wide range of target temperatures by using different phase change materials. For example, $H_2O$ melts at 0° C., $D_2O$ melts at +4° C., a 20% ethylene glycol solution melts at −8° C. and a 50% ethylene glycol solution melts at −37° C. This permits use of insulted shipping containers for a broad range of thermally labile goods. However, packaging mistakes can occur when different thermally labile goods requiring use of different phase change materials are packaged at a single location, such as placement of thermally labile goods in an insulated shipping container charged with the wrong phase change material.

Accordingly, a substantial need exists for a straightforward, fool-proof system that ensures proper matching of thermally labile goods and phase change materials in an insulated shipping container.

SUMMARY OF THE INVENTION

The invention is a method of packaging thermally labile goods. The method includes the steps of: (a) obtaining a thermally insulated container defining a retention chamber, (b) obtaining thermally labile goods to be packaged, (c) obtaining a legend correlating listed thermally labile goods with a color, (d) locating the thermally labile goods to be packaged on the legend and identifying the correlated color, (e) obtaining thermally conditioned panels of the correlated color wherein the panels contain a phase change material and the panels are color coded in relation to the phase change temperature of the phase change material contained within the panels, (f) lining the retention chamber with the obtained thermally conditioned panels, (g) placing the thermally labile goods to be packaged into the lined retention chamber, and (h) closing the container.

BRIEF DESCRIPTION OF THE DRAWINGS

FIG. 2A is a front view of one embodiment of a legend useful in practicing the invention.

FIG. 2B is a front view of a second embodiment of a legend useful in practicing the invention.

DETAILED DESCRIPTION OF A PREFERRED EMBODIMENT

Nomenclature

Figure 1:
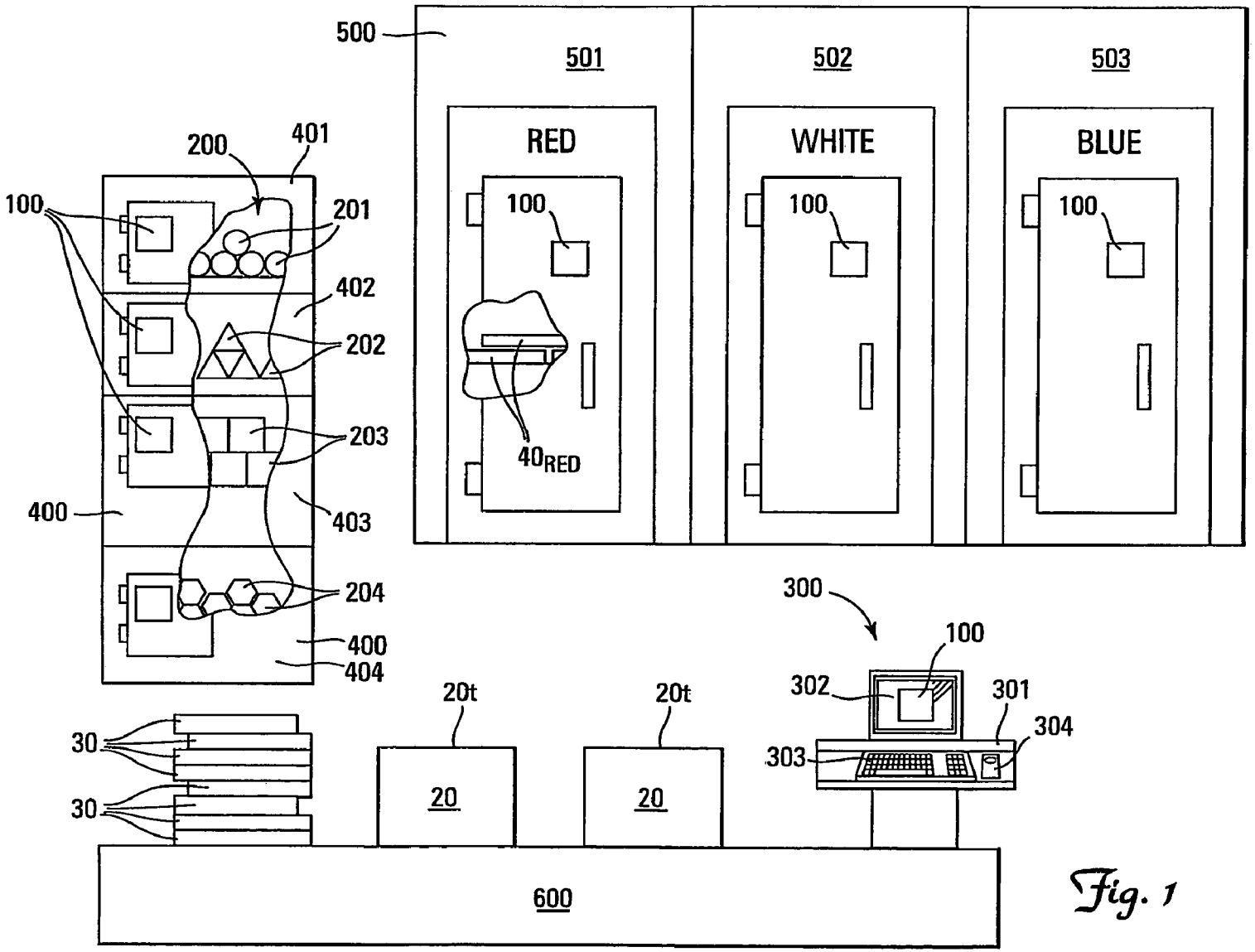
FIG. 1 is front view of one embodiment of an assembly and packaging area useful in practicing the invention with portions of the refrigeration units removed to facilitate viewing of the contents.

10 Thermally Insulated Container
**10*t*** Top of Container
19 Retention Chamber defined by Container
20 Outer Shell
**20*t*** Top of Outer Shell
21 Cover Flaps for Top of Outer Shell
30 Insulating Panels
**30*t*** Top Insulating Panel
40 Panels of Phase Change Material
**40*t*** Top Panel of Phase Change Material
$\mathbf{40}_{Red}$ Red Panels of First Phase Change Material
$\mathbf{40}_{White}$ White Panels of Second Phase Change Material
$\mathbf{40}_{Blue}$ Blue Panels of Third Phase Change Material
50 Phase Change Material
100 Legend
200 Thermally Labile Goods
201 First Type of Thermally Labile Goods
202 Second Type of Thermally Labile Goods
203 Third Type of Thermally Labile Goods
204 Fourth Type of Thermally Labile Goods
300 Computer
301 Central Processing Unit
302 Monitor
303 Keyboard
304 Mouse
400 First Refrigeration Unit for Thermally Labile Goods
401 First Refrigeration Chamber
402 Second Refrigeration Chamber
403 Third Refrigeration Chamber
404 Fourth Refrigeration Chamber
500 Second Refrigeration Unit for Panels of Phase Change Material
501 First Refrigeration Chamber
502 Second Refrigeration Chamber
503 Third Refrigeration Chamber
600 Work Table Construction The invention is directed to a method of packaging thermally labile goods 200 in thermally insulated shipping containers 10 equipped with panels of phase change material 40 (hereinafter PCM panels) when the temperature range within which the thermally labile goods 200 must be maintained (hereinafter target temperature range) can vary from container 10 to container 10.

The steady-state temperature maintained within the thermally insulated shipping container 10 can be adjusted to match the target temperature range of the thermally labile goods 200 by using PCM panels 40 containing different phase change materials. For example, PCM panels 40 containing frozen $D_2O$ provide a steady-state temperature at about +4° C. (the melt temperature of $D_2O$), while PCM panels 40 containing frozen $H_2O$ provide a steady-state temperature at about 0° C. (the melt temperature of $H_2O$), PCM panels 40 containing a frozen 20% ethylene glycol solution provide a steady-state temperature at about −8° C. (the melt temperature of a 20% ethylene glycol solution) and PCM panels 40 containing a frozen 50% ethylene glycol solution provide a steady-state temperature at about −37° C. (the melt temperature of a 20% ethylene glycol solution).

Figure 3:
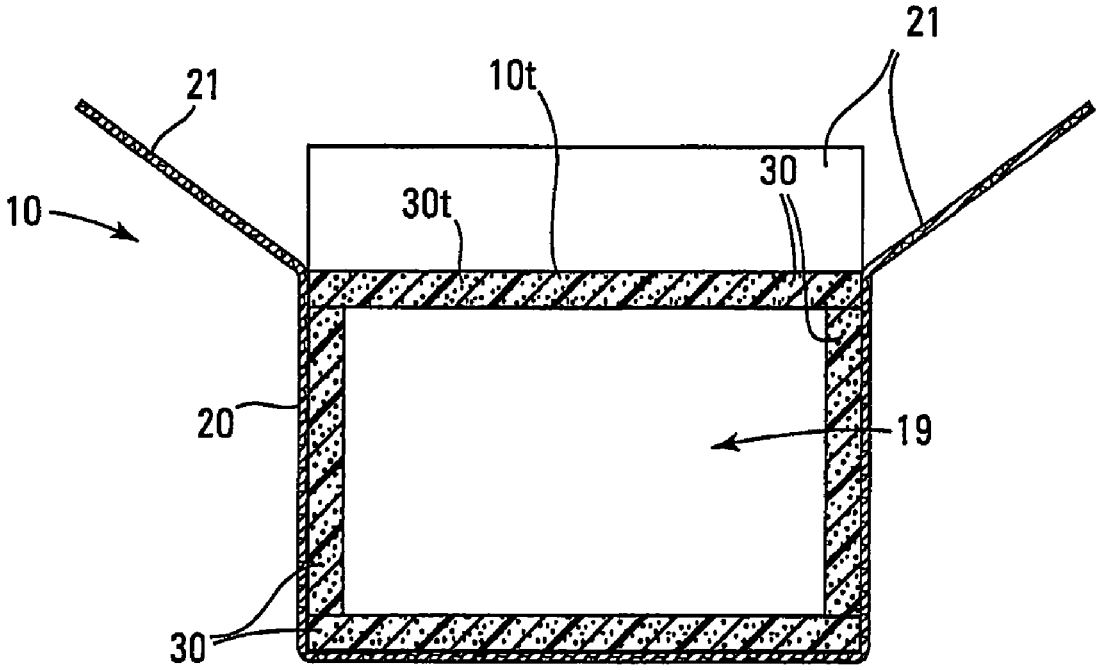
FIG. 3 is a cross-sectional side view of one embodiment of a thermally insulated container useful in practicing the invention.

The method includes the preliminary steps of obtaining a thermally insulated container 10 defining a retention chamber 19, and obtaining thermally labile goods 200 to be packaged. Substantially any thermally insulated container 10 configured and arranged for retaining thermally labile goods 200 and one or more PCM panels 40 are suitable for use in the present process. An exemplary thermally insulated container 10 comprising an outer cardboard shell 20 with cover flaps 21 over the top 20*t* of the shell 20, and a lining of insulating panels 30 is depicted in FIG. 3. Other suitable thermally insulated containers 10 are described in U.S. Pat. Nos. 4,145,895; 4,579,170; 4,923,077; 4,931,333; 5,626,936; 5,899,088; 6,209,343 and 6,718,776, and United States Patent Application Publications 2005/0188714; 2004/0079794; 2004/0079793 and 2002/0050147.

In order to simplify the packaging process and limit the number of different items that need to be ordered and retained in inventory, it is generally desired to use the same thermally insulated containers 10 for packaging all of the various thermally labile goods 200 to be packaged at the particular location.

A wide variety of thermally labile goods 200 requiring storage within a given target temperature range are used across various industry segments ranging from blood to thermometers. A nonexhaustive list of thermally labile goods 200 which may be quickly, conveniently and reliably packaged using the method of this invention include blood, blood products such as red blood cells (RCBs) and blood platelets, transplantable organs, biological tissue, vaccines, antigens, antibodies, bacteriological samples, immunoassays, pharmaceuticals, enzymes, and single-use chromogenic thermometers.

For purposes of facilitating further discussion of the invention, the invention will be described in connection with the packaging of mythical thermally labile goods 200 identified simply as ❍❍❍and ✱✱✱(thermally labile goods having a target temperature of 4° C.), ❑❑❑and ΔΔΔ (thermally labile goods having a target temperature of 0° C.), and ⊙⊙⊙and ●●● (thermally labile goods having a target temperature of −20° C.).

The method includes the additional preliminary steps of obtaining a legend 100 correlating listed thermally labile goods 200 with a color (e.g., black or white), or color scheme (e.g., black and white stripes or red and yellow checkerboard pattern) based upon the target temperature of the thermally labile goods 200. Exemplary legends 100 are depicted in FIGS. 2A and 2B wherein ❍❍❍and ✱✱✱(thermally labile goods 200 having a target temperature of 4° C.) are correlated to the color red, ❑❑❑and ΔΔΔ (thermally labile goods 200 having a target temperature of 0° C.) are correlated to the color white, and ⊙⊙⊙and ●●● (thermally labile goods 200 having a target temperature of −20° C.) are correlated to the color blue. The correlation may be represented in any suitable fashion with two acceptable representations shown in FIG. 2A (individually depicting each thermally labile good 200 with the correlated color or color scheme) and FIG. 2B (grouping thermally labile goods 200 by correlated color or color scheme).

The legend 100 may be made available in any desired form including printed hardcopy or electronic form. Referring to FIG. 1, hardcopy versions are inexpensive and permit posting of the legend 100 in appropriate locations around the packaging area, such as proximate the access doors (not numbered) on the various refrigeration units 400 and 500, while electronic versions require access to a computer 300 but facilitate updating of the legend 100 and permit keyword searches to facilitate location of particular thermally labile goods 200 on the legend 100.

Figure 4A:
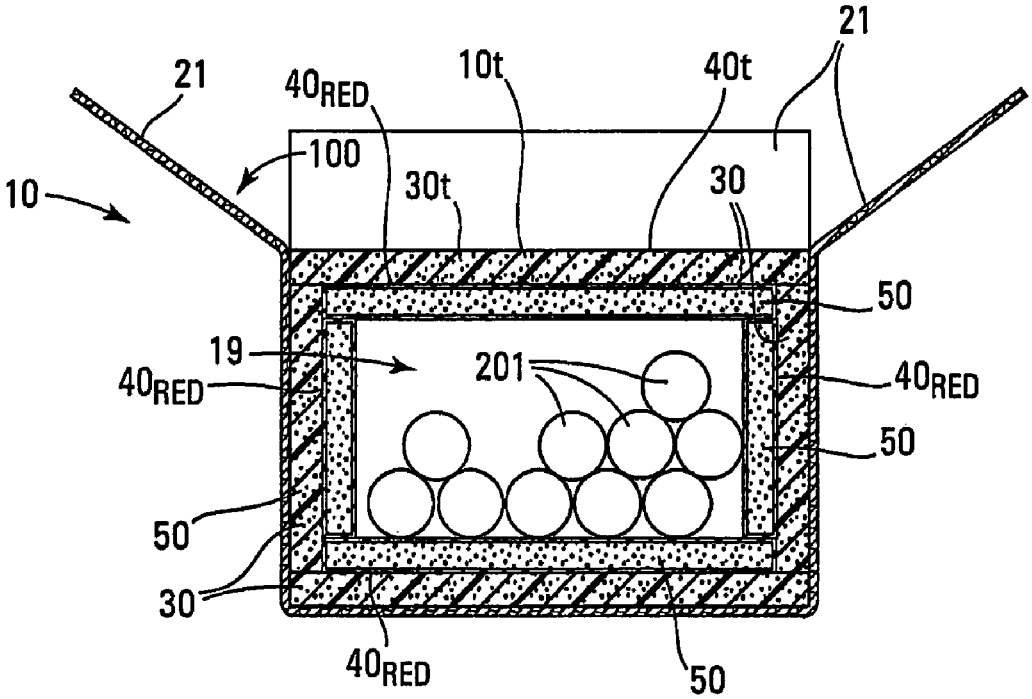
FIG. 4A is a cross-sectional side view of the thermally insulated container of FIG. 3 packaged with a first thermally labile good in accordance with the invention.
Figure 4B:
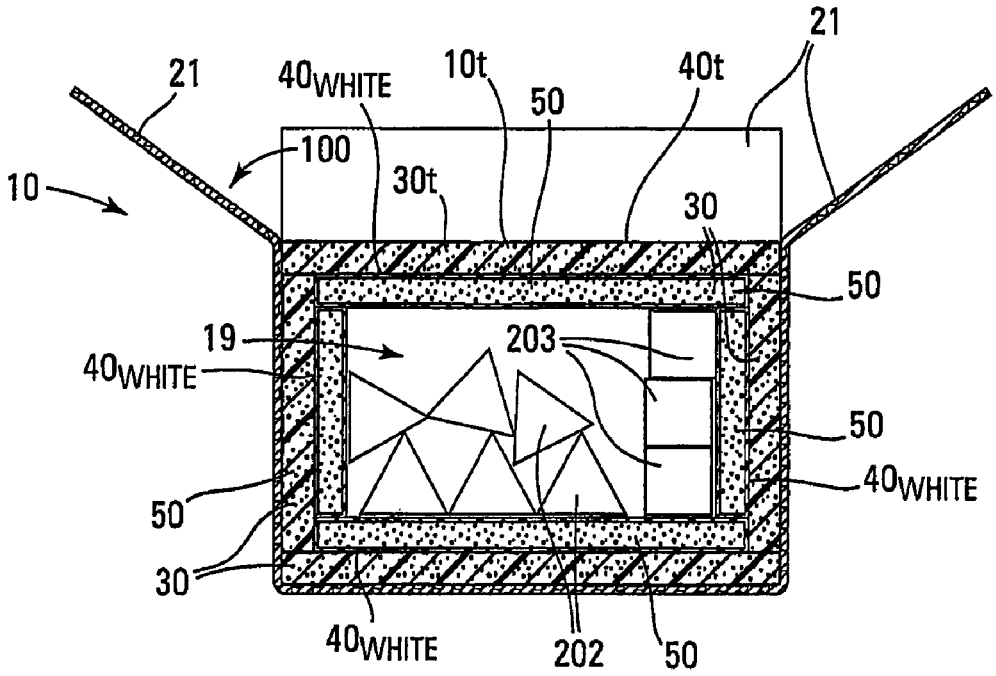
FIG. 4B is a cross-sectional side view of the thermally insulated container of FIG. 3 packaged with second and third thermally labile goods in accordance with the invention.
Figure 4C:
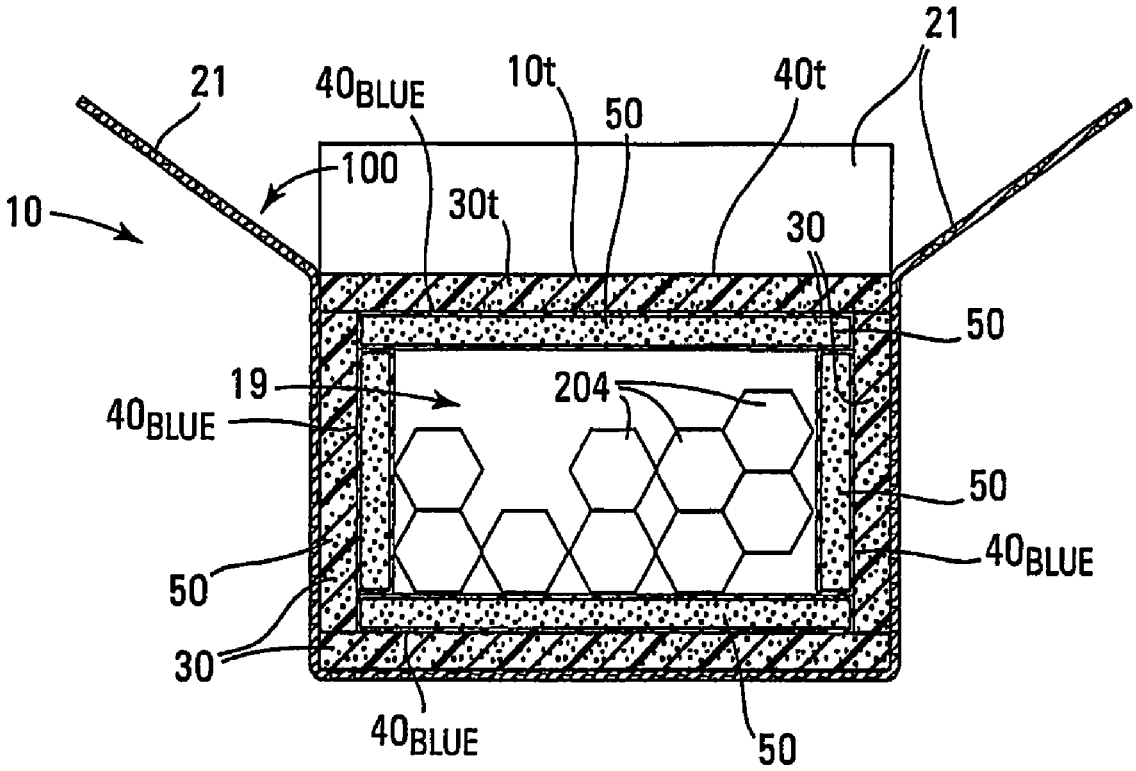
FIG. 4C is a cross-sectional side view of the thermally insulated container of FIG. 3 packaged with a fourth thermally labile good in accordance with the invention.

Once the legend 100 has been obtained, the thermally labile goods 200 to be packaged can be located on the legend and the correlated color or color scheme identified. The identified color or color scheme indicates the color or color scheme of the PCM panel 40 to be deployed in the thermally insulted container 10 for the thermally labile goods 200. The thermally conditioned PCM panels 40 of the correlated color or color scheme, containing a phase change material 50 providing the appropriate steady state temperature for the thermally labile goods 200 being packaged, can then be withdrawn from the appropriate refrigeration chamber 501, 502 or 503 and inserted into the retention chamber 19 of a thermally insulated container 10. As shown in FIGS. 4A, 4B and 4C, the PCM panels 40 preferably line the retention chamber 19.

The thermally labile goods 200 to be packaged can finally be placed into the retention chamber 19 and the container 10 closed.

EXAMPLES

Example I

Prophetic

Referring to FIG. 1, a packaging area (unnumbered) is equipped with (i) a computer 300 including a central processing unit 301, monitor 302, keyboard 303 and mouse 304, (ii) a first refrigeration unit 400 with three separate independently controlled refrigeration chambers 401, 402 and 403, (iii) a second refrigeration unit 500 with three separate independently controlled refrigeration chambers 501, 502 and 503, and (iv) a work table 600.

As represented in FIG. 1, a supply of cardboard outer shells 20 and complimentary insulating panels 30 are provided in the work area.

Referring to FIG. 1, this facility currently ships four different thermally labile goods 201, 202, 203 and 204. A supply of each of these thermally labile goods 201, 202, 203 and 204 is stored in the four refrigeration chambers 401, 402, 403 and 404 of the first refrigeration unit 400 respectively, with each refrigeration chamber 401, 402, 403 and 404 maintained within the target temperature range of the thermally labile goods stored therein. (i.e., the first refrigeration chamber 401 containing the first thermally labile good 201 (❍❍❍) maintained at 4° C., the second refrigeration chamber 402 containing the second thermally labile good 202 (ΔΔΔ) maintained at 0° C., and the third refrigeration chamber 403 containing the third thermally labile good 203 (❑❑❑) maintained at 0° C.) and the fourth refrigeration chamber 404 containing the fourth thermally labile good 204 (●●●) maintained at −35° C.).

Referring to FIG. 1, in order to accommodate packaging of the four different thermally labile goods 201, 202, 203 and 204 shipped at the facility, three different PCM panels $\mathbf{40}_{Red}$, $\mathbf{40}_{White}$ and $\mathbf{40}_{Blue}$ are stored in the three refrigeration chambers 501, 502 and 503 of the first refrigeration unit 500 respectively, with each refrigeration chamber 501, 502 and 503 maintained at a temperature below the freezing point of the phase change material 50 retained within the PCM panel 40 (i.e., the first refrigeration chamber 501 containing the red colored PCM panels $\mathbf{40}_{Red}$ filled with $D_2O$ phase change material 50 maintained at 2° C., the second refrigeration chamber 502 containing white colored PCM panels $\mathbf{40}_{White}$ filled with $H_2O$ phase change material 50 maintained at −2° C., and the third refrigeration chamber 503 containing the blue colored PCM panels $\mathbf{40}_{Blue}$ filled with a 40% solution of ethylene glycol phase change material 50 maintained at −40° C.).

An order is received to ship ten units of the first thermally labile good 201 (❍❍❍), six units of the second thermally labile good 202 (ΔΔΔ), three units of the third thermally labile good 203 (❑❑❑) and nine units of the fourth thermally labile good 204 (●●●) to a single site.

The ordered thermally labile goods 200 are located on the legend 100 and the corresponding PCM panel color ascertain from the legend 100 as set forth below.

| | |
|---|---|
| First Thermally Labile Good 201 (❍❍❍) | Red PCM Panels $40_{Red}$ |
| Second Thermally Labile Good 202 (ΔΔΔ) | White PCM Panels $40_{White}$ |
| Third Thermally Labile Good 203 (❑❑❑) | White PCM Panels $40_{White}$ |
| Fourth Thermally Labile Good 204 (●●●) | Blue PCM Panels $40_{Blue}$ |

Since the second 202 (ΔΔΔ) and third 203 (❑❑❑) thermally labile goods correlate to the same PCM panels 40, they may be packaged together. Hence, three rather than four cardboard outer shells 20 are obtained, placed on the work table 600 and lined along the bottom (unnumbered) and four sides (unnumbered) with insulating panels 30 to form three thermally insulted containers 10 with open tops 10*t*.

Thermally conditioned red PCM panels $\mathbf{40}_{Red}$ are obtained from the first refrigeration chamber 501 of the second refrigeration unit 500 and one of the thermally insulted containers 10 lined along the bottom and sides with the red PCM panels $\mathbf{40}_{Red}$ to form a first PCM lined thermally insulted container 10 with an open top 10*t*. Ten units of the first thermally labile good 201 (❍❍❍) are withdrawn from the first refrigeration chamber 401 of the first refrigeration unit 400 and placed within the retention chamber 19 defined by the first PCM lined thermally insulted container 10 through the open top 10*t*. A top PCM panel 40*t* (also red) and a top insulating panel 30*t* are sequentially placed over the open top 10*t* of the first PCM lined thermally insulated container 10 and the cover flaps 21 on the outer shell 20 closed. The finished container is depicted in FIG. 4A.

In similar fashion, thermally conditioned white PCM panels $\mathbf{40}_{White}$ are obtained from the second refrigeration chamber 502 of the second refrigeration unit 500 and a second of the thermally insulted containers 10 lined along the bottom and sides with the white PCM panels $\mathbf{40}_{White}$ to form a second PCM lined thermally insulted container 10 with an open top 10*t*. Six units of the second thermally labile good 202 (ΔΔΔ) and three units of the third thermally labile good 203 (❑❑❑) are withdrawn from the second refrigeration chamber 402 and third refrigeration chamber 403 of the first refrigeration unit 400 respectively, and placed within the retention chamber 19 defined by the second PCM lined thermally insulted container 10 through the open top 10*t*. A top PCM panel 40*t* (also white) and a top insulating panel 30*t* are sequentially placed over the open top 10*t* of the second PCM lined thermally insulated container 10 and the cover flaps 21 on the outer shell 20 closed. The finished container is depicted in FIG. 4B.

Lastly, thermally conditioned blue PCM panels $\mathbf{40}_{Blue}$ are obtained from the third refrigeration chamber 503 of the second refrigeration unit 500 and the last of the thermally insulted containers 10 lined along the bottom and sides with the blue PCM panels $\mathbf{40}_{Blue}$ to form a third PCM lined thermally insulted container 10 with an open top 10*t*. Nine units of the fourth thermally labile good 204 (●●●) are withdrawn from the fourth refrigeration chamber 404 of the first refrigeration unit 400 and placed within the retention chamber 19 defined by the third PCM lined thermally insulted container 10 through the open top 10*t*. A top PCM panel 40*t* (also blue) and a top insulating panel 30*t* are sequentially placed over the open top 10*t* of the third PCM lined thermally insulated container 10 and the cover flaps 21 on the outer shell 20 closed. The finished container is depicted in FIG. 4C.

I claim:

1. A method of packaging thermally labile goods, comprising:

(a) obtaining a thermally insulated container defining a retention chamber;

(b) obtaining thermally labile goods to be packaged;

(c) obtaining a legend correlating listed thermally labile goods with a color;

(d) locating the thermally labile goods to be packaged on the legend and identifying the correlated color;

(e) obtaining thermally conditioned panels of the correlated color wherein the panels contain a phase change material and the panels are color coded in relation to the phase change temperature of the phase change material contained within the panels;

(f) lining the retention chamber with the obtained thermally conditioned panels;

(g) placing the thermally labile goods to be packaged into the lined retention chamber; and (h) closing the container.

2. The method of claim 1 wherein the thermally insulated container has an outer shell of cardboard.

3. The method of claim 1 wherein the retention chamber is surrounded by thermal insulation.

4. The method of claim 1 wherein the retention chamber has a volume of about 300 $cm^3$ to about 200,000 $cm^3$.

5. The method of claim 1 wherein the thermally labile goods to be packaged are a biological material.

6. The method of claim 5 wherein the thermally labile goods are at least one of human blood and a human blood product.

7. The method of claim 1 wherein the legend lists at least two different thermally labile goods correlated to at least two different colors.

8. The method of claim 1 wherein the legend lists at least three different thermally labile goods correlated to at least two different colors.

9. The method of claim 1 wherein the legend lists at least three different thermally labile goods correlated to at least three different colors.

10. The method of claim 1 wherein locating the thermally labile goods to be packaged on the legend comprises browsing a printed copy of the legend.

11. The method of claim 1 wherein locating the thermally labile goods to be packaged on the legend comprises browsing an electronic copy of the legend.

12. The method of claim 1 wherein locating the thermally labile goods to be packaged on the legend comprises performing a keyword search of an electronic database of the legend.

13. The method of claim 1 wherein the thermally conditioned panels may be selected from at least two different colors of panels having different phase change materials with different melt temperatures.

14. The method of claim 13 wherein the phase change materials are selected from at least two of $H_2O$, $D_2O$, ethylene glycol, propylene glycol and a mixture of $H_2O$ and glycol.

15. The method of claim 1 wherein the step of lining the retention chamber with the obtained thermally conditioned panels comprises surrounding the retention chamber with the panels.

16. The method of claim 1 comprising the additional step of repeating steps (a) through (h) for different thermally labile goods.

17. The method of claim 16 wherein all steps are performed at a single site.

* * * * *